United States Patent [19]

Adams, III

[11] Patent Number: 4,862,533

[45] Date of Patent: Sep. 5, 1989

[54] SLEEPING BAG AND AN AIR MATTRESS

[76] Inventor: Mark H. Adams, III, 314 N. Pinecrest, Wichita, Kans. 67208

[21] Appl. No.: 98,409

[22] Filed: Sep. 18, 1987

[51] Int. Cl.[4] ..... H47G 9/08

[52] U.S. Cl. ..... 5/413; 417/472; 417/903

[58] Field of Search ..... 5/413, 454; 417/472, 417/703

[56] References Cited

U.S. PATENT DOCUMENTS

| | | | |
|---|---|---|---|
| 867,464 | 10/1907 | Abbott | 5/413 X |
| 3,068,494 | 12/1962 | Pinkwater | 417/441 X |
| 4,092,750 | 6/1978 | Ellis | 5/413 |

FOREIGN PATENT DOCUMENTS

| | | | |
|---|---|---|---|
| 095551 | 12/1983 | European Pat. Off. | 5/413 |
| 2305154 | 11/1976 | France | 5/413 |
| 702513 | 1/1954 | United Kingdom | 5/413 |

*Primary Examiner*—Alvin C. Chin-Shue
*Attorney, Agent, or Firm*—John W. Carpenter

[57] ABSTRACT

An inflatable air mattress in combination with a sleeping bag. The air mattress is slidably disposed with in a zipper controlled pocket with the sleeping bag. The air mattress includes an electric pump, a bellows member or the like, which when energized or operated expands the inflatable air mattress within the sleeping bag in order to provide a cushioning effect for the user of the sleeping bag.

16 Claims, 6 Drawing Sheets

FIG. 1
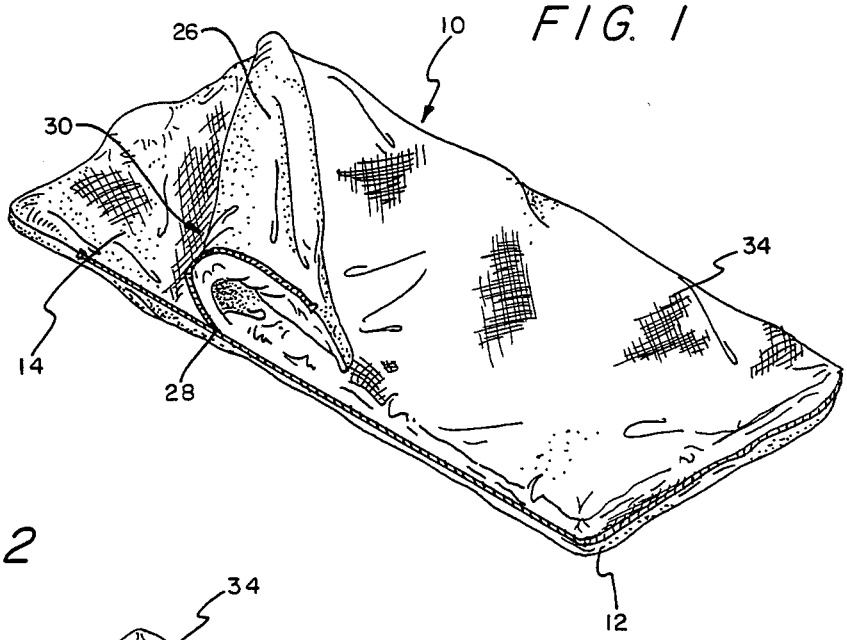
FIG. 2
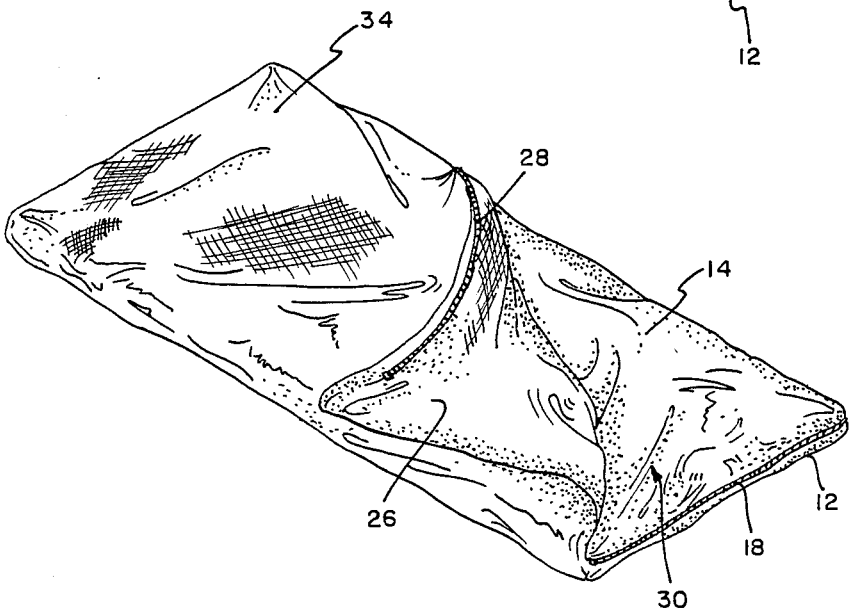
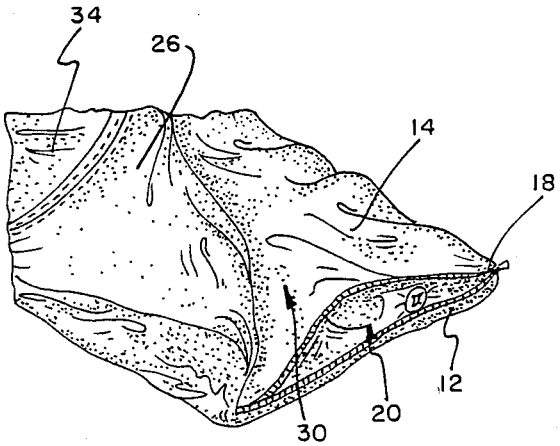
FIG. 3

FIG. 4
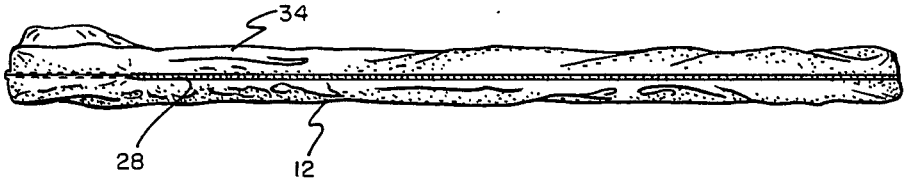
FIG. 5
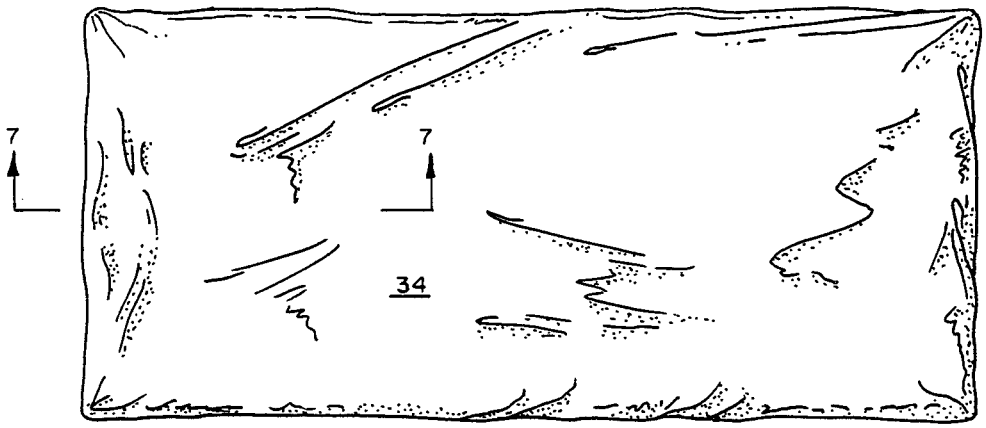
FIG. 6
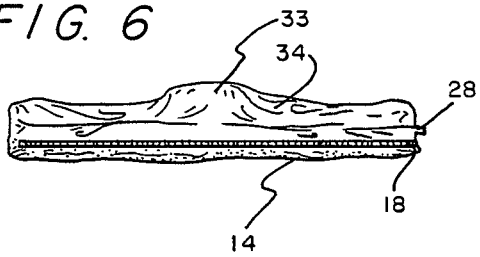
FIG. 7
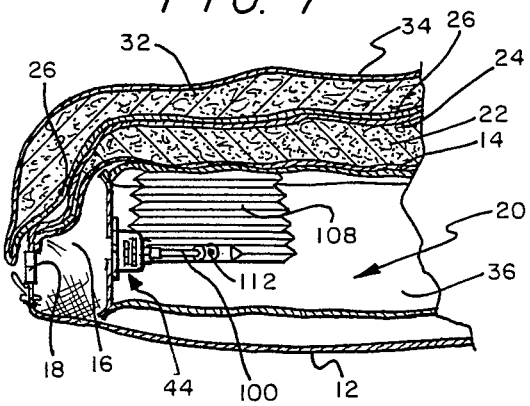
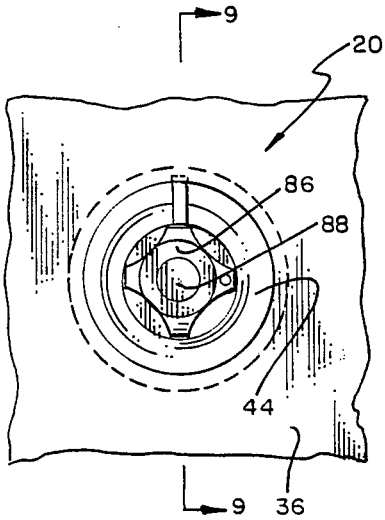
FIG. 8

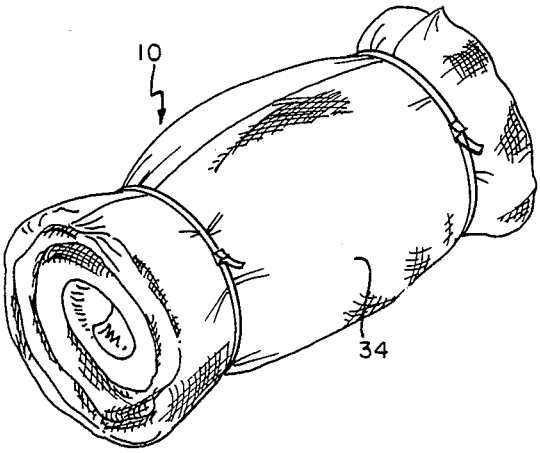
FIG. 14
FIG. 15
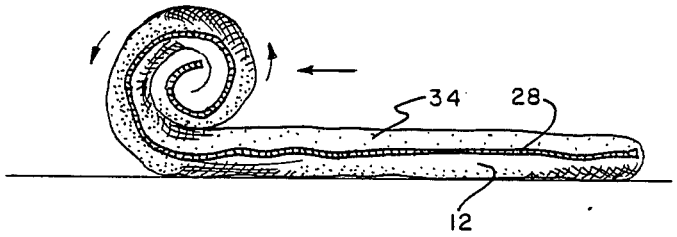
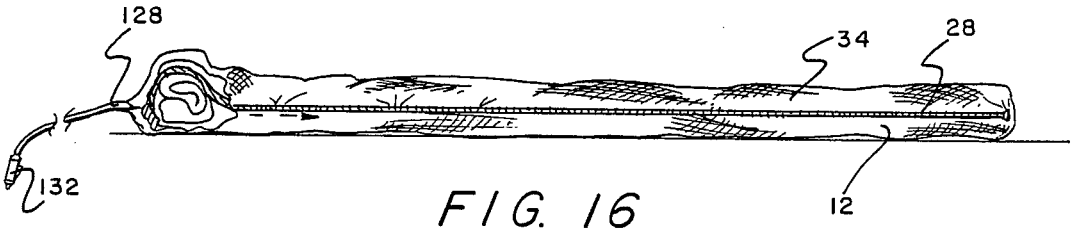
FIG. 16
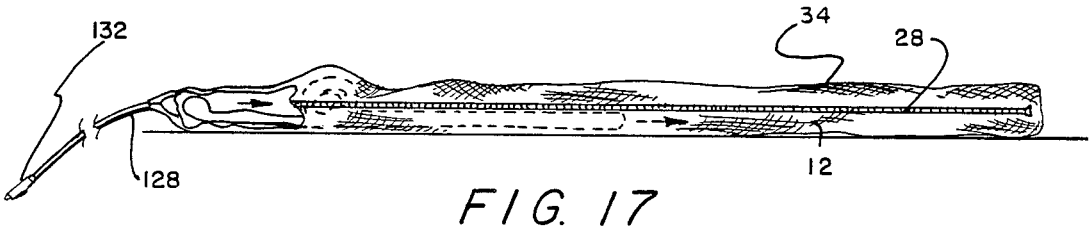
FIG. 17
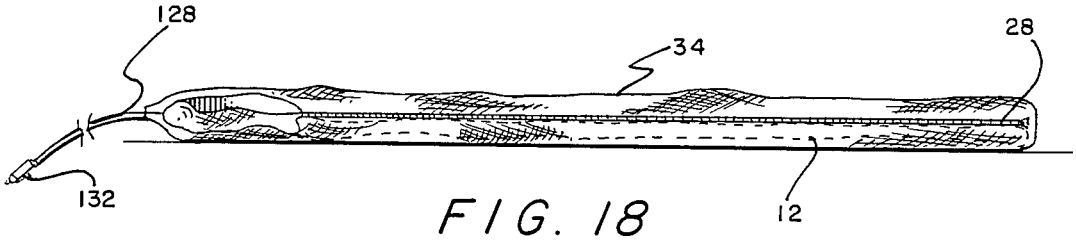
FIG. 18

FIG. 19
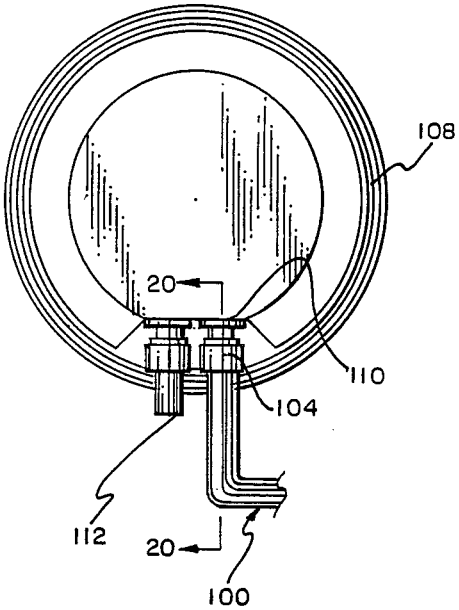
FIG. 20
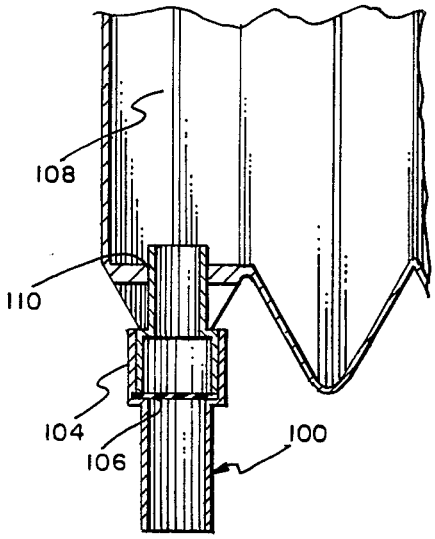
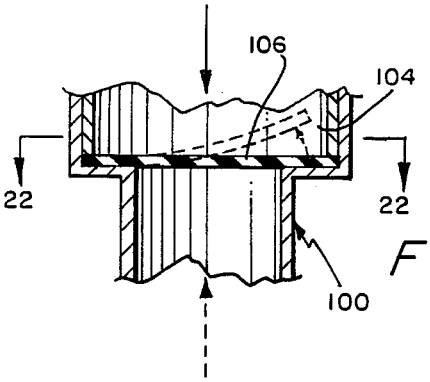
FIG. 21
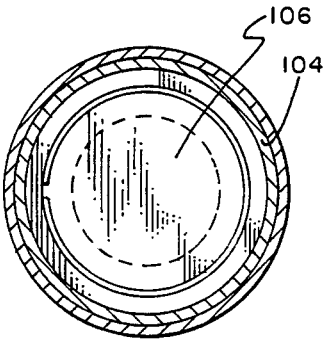
FIG. 22
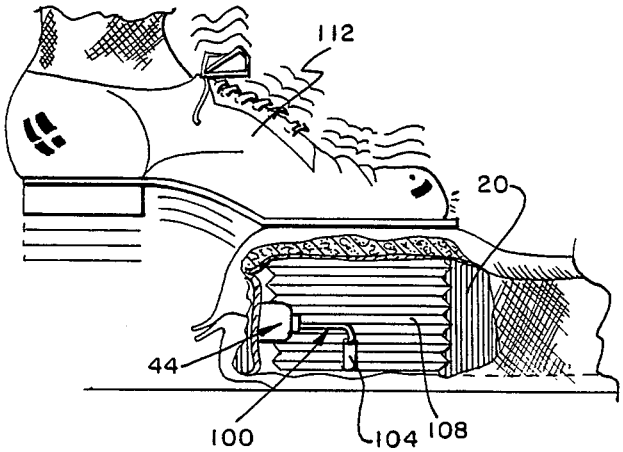
FIG. 23

SLEEPING BAG AND AN AIR MATTRESS

FIELD OF THE INVENTION

This invention is related to an inflatable air mattress. More specifically, this invention provides an inflatable air mattress in combination with a sleeping bag.

DESCRIPTION OF THE PRIOR ART

A patentability investigation was conducted and the following United States patents were discovered: Nos. 1,648,373; 2,620,193; 3,798,686; 4,091,482; 4,092,750; 2,068,134; 2,369,737; 2,686,006; 3,068,494; 3,112,502; 3,133,696; 3,155,991; 3,533,113; 3,583,208; and 4,504,986. None of the foregoing prior art patents teach or suggest the particular air mattress/sleeping bag combination of this invention.

SUMMARY OF THE INVENTION

The present invention in its broadest aspect accomplishes its desired objects by broadly providing an inflatable air mattress and a sleeping bag means. The sleeping bag means has a bottom layer and a first intermediate layer secured to the bottom layer such as to form a first closeable pocket. The air mattress is slidably disposed within the first pocket and has a pump means for inflating it to a desired level. The sleeping bag additionally has a first cushioning and/or insulation means imposed on the first intermediate layer and a second intermediate layer secured to the first intermediate layer such as to encapsulate the first cushioning and insulation means. A third intermediate layer is attached to the second intermediate layer to form a second closeable pocket wherebetween the user of the sleeping bag means rests and lies. A second cushioning and insulation means is imposed on the third intermediate layer, and a top layer is bound to the third intermediate layer to encapsulate the second cushioning and insulation means therebetween.

It is therefore an object of this invention to provide an inflatable air mattress.

It is another object of the present invention to provide a combination inflatable air mattress/sleeping bag.

These, together with the various ancillary objects and features which will become apparent to those skilled in the art as the following description proceeds, are attained by this novel air mattress and sleeping bag, a preferred embodiment being shown with reference to the accompanying drawings, by way of example only, wherein:

BRIEF DESCRIPTION OF THE DRAWINGS

FIG. 1 is a perspective view from the bottom of the air mattress and sleeping bag combination;

FIG. 2 is a perspective view from the top of the air mattress and sleeping bag combination;

FIG. 3 is a partial perspective view illustrating the opening where the inflatable air mattress lodges;

FIG. 4 is a side elevational view of the sleeping bag with the air mattress slidably disposed therein in an expanded position;

FIG. 5 is a top plan view of the air mattress and sleeping bag combination of FIG. 4;

FIG. 6 is a top end elevational view of the air mattress and sleeping bag combination of FIG. 4;

FIG. 7 is a partial vertical sectional view of the air mattress and sleeping bag combination taken in direction of the arrows and along the plane of line 7—7 in FIG. 5;

FIG. 8 is a partial side elevational view of an end of the air mattress disclosing the bowl member and the lid rotatably engaged to the hollow bushing which is also rotatably engaged to a hollow coupling slidably lodged within the bowl member;

FIG. 14 is a perspective view of the air mattress and sleeping bag combination in a rolled position;

FIG. 15 is a side elevational view of the air mattress and sleeping bag combination of FIG. 14 being unrolled;

FIG. 16 is a side elevational view of the air mattress and sleeping bag combination of FIG. 14 in an unrolled position;

FIG. 17 is a side elevational view of the air mattress and sleeping bag combination of FIG. 14 being inflated with the motor means;

FIG. 18 is a side elevational view of the air mattress and sleeping bag combination of FIG. 14 with the air mattress in an inflated position;

FIG. 19 is a bottom plan view of the bellows member of FIG. 10;

FIG. 20 is a partial vertical sectional view of the sleeping bag and air mattress combination taken in direction of the arrows and along the plane of line 20—20 in FIG. 19;

FIG. 21 is a partial vertical sectional view of an end of the elbow member with the dotted line position representing the movement and position of the diaphragm where air is being intaken;

FIG. 22 is a partial horizontal view of the sleeping bag and air mattress combination taken in direction of the arrows and along the plane of line 22—22 in FIG. 21; and FIG. 23 is a partial side elevational view of the bellows member being pumped up and down with a foot in order to inflate the air mattress within the sleeping bag.

DETAILED DESCRIPTION OF THE INVENTION

Figure 9:
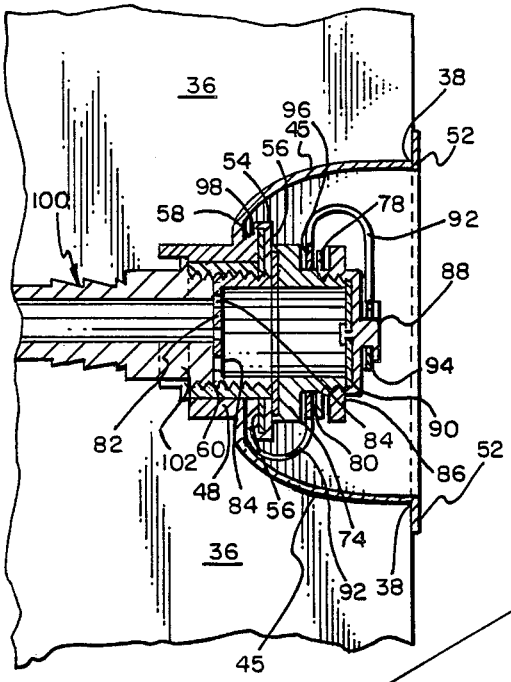
FIG. 9 is a partial vertical sectional view of the air mattress and sleeping bag combination taken in direction of the arrows and along the plane of line 9—9 in FIG. 8.

Referring in detail now to the drawings, wherein similar parts of the invention are identified by like reference numerals, there is seen a sleeping bag, generally illustrated as 10, consisting of a bottom layer 12, an intermediate layer 14 secured or integrally bound to the bottom layer 12 such as to form a pocket, generally illustrated as 16, therebetween. A zipper or other fastening means 18 is secured to the layers 12 and 14 in order to open and close the pocket 16. An inflatable air mattress, generally illustrated as 20, is removably disposed within the pocket 16 such as to be between the two layers 12 and 14. A cushioning and/or insulation means 22 is imposed on or over the layer 14. An intermediate layer 24 is connected or secured to the layer 14 such as to enclose or encapsulate the cushioning and insulation means 22. An intermediate layer 26 is attached or connected releasably via a zipper or other fastening means 28 to the layer 24 to form another pocket 30 that is opened and closed through the use of the zipper means 28. As indicated in FIGS. 1 and 2, pocket 30 is not completely open or closed at any particular time but is always open on at least one side because the zipper means 28 does not zip all the way around layers 24 and 26. The user of the sleeping bag 10 lies within pocket 30 with the head positioned at the open end of the pocket 30. A cushioning and/or insulation means 32 is imposed on layer 26 and a top layer 34 is attached to or bound integrally to the layer 26 such as to enclose or encapsulate the cushioning and/or insulation means 32. It should be understood that the cushioning and/or insulation means 32 may be thickened between layers 26 and 34 near the head such as to form a pillow means 33 which would be resting on top of the pump means identified below as 42 (see FIGS. 4 and 6).

Figure 10:
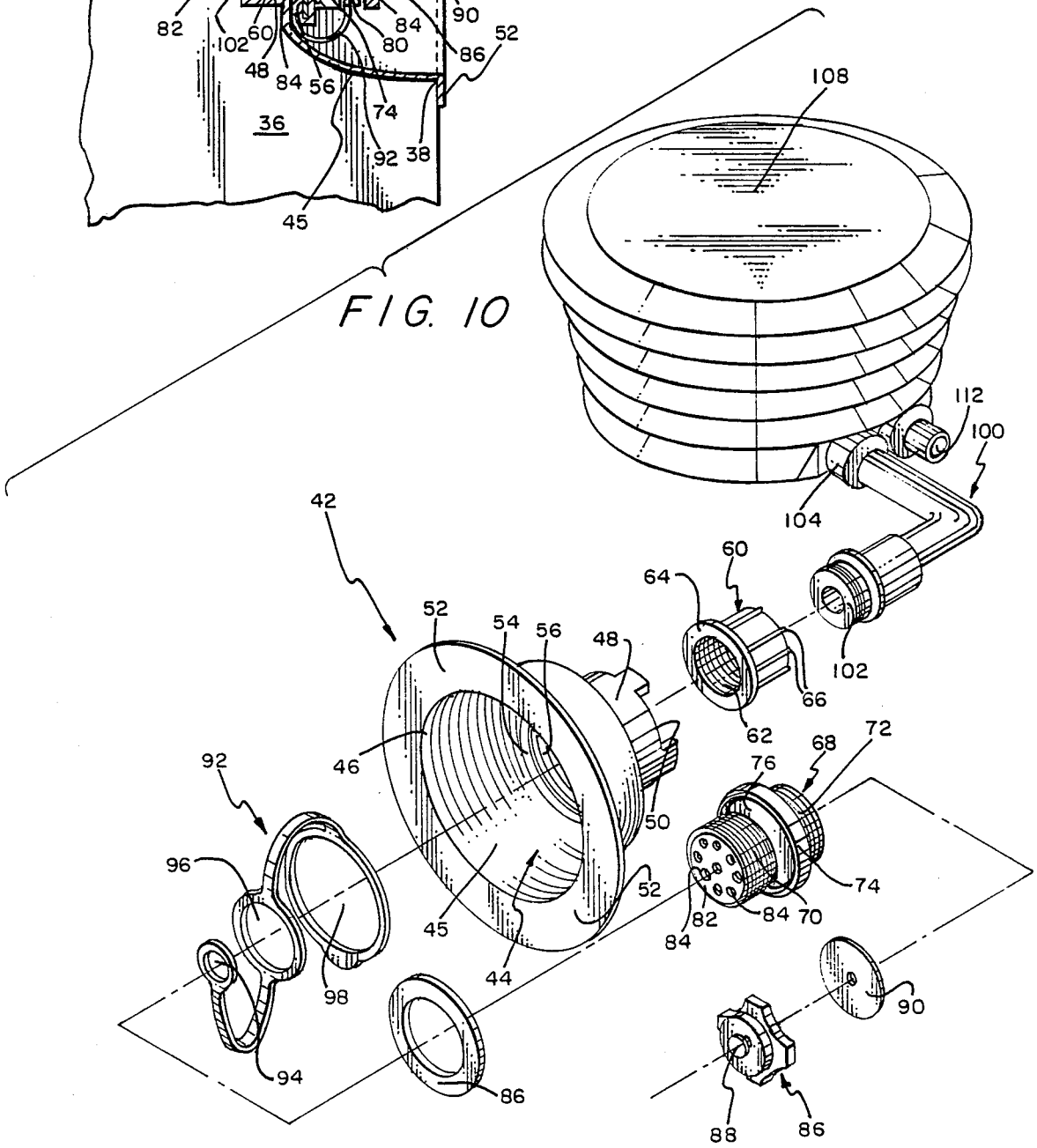
FIG. 10 is an exploded segmented perspective view of the various parts of the pump means for inflating the inflatable air mattress.
Figure 11:
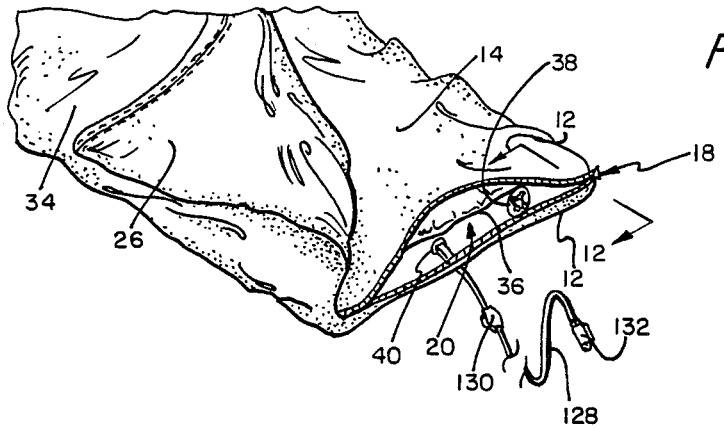
FIG. 11 is a partial perspective view of the opening in the sleeping bag having the inflatable air mattress slidably disposed therein wherein the air mattress has a motor means for inflating the same.
Figure 12:
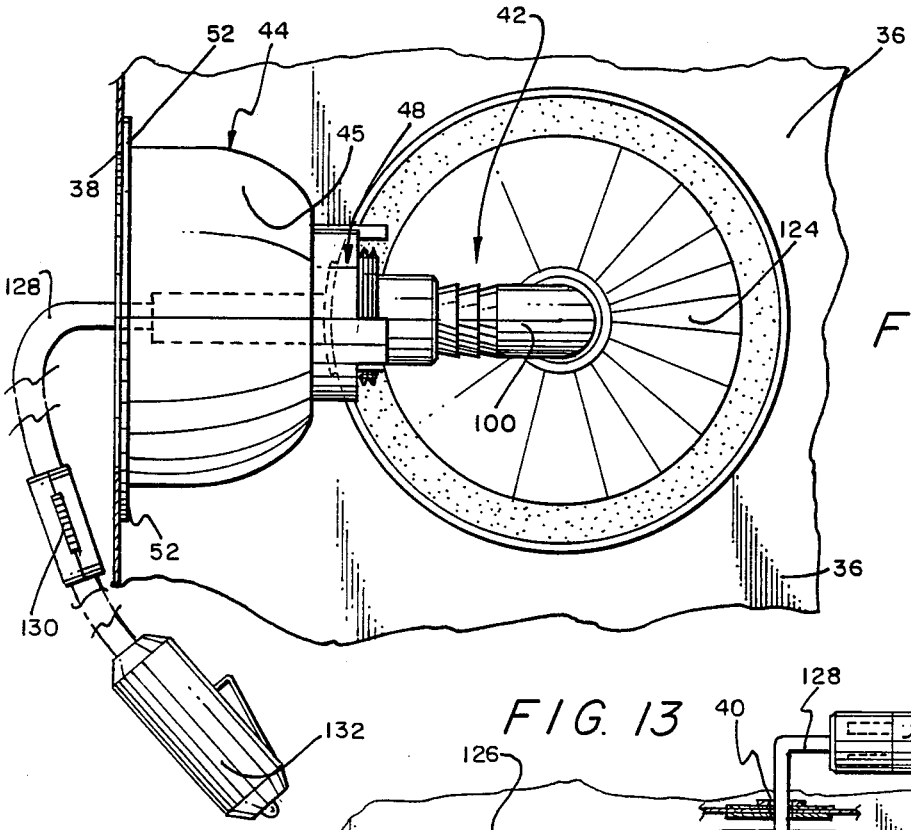
FIG. 12 is a partial vertical sectional view of the air mattress and sleeping bag combination taken in direction of the arrows and along the plane of line 12—12 in FIG. 11.

The inflatable air mattress 20 of this invention includes a totally enclosed mattress structure or housing 36 having an air intake aperture 38 and in one preferred embodiment of the invention, a cord inlet/outlet aperture 40 (see FIG. 9). Housing 36 may be constructed of any suitable impervious material, such as pliable plastic or a plastic sold under the trademark MYLAR, a trademark of DuPont. A pump means, generally illustrated as 42 in FIG. 10, is disposed within the mattress structure or housing 36 for intaking air through the air intake aperture 38. The pump means 42 comprises a bowl member, generally illustrated as 44, having a side 45 and an open top 46 with a top diameter and a bowl bottom, generally illustrated as 48, having a bottom opening 50 with a bottom diameter smaller than the top diameter. The periphery of the open top 46 is circumscribed with a bowl flange 52 that secures around the air intake aperture 38 (see FIGS. 9 and 12). The bowl bottom 48 has a bottom bowl flange 54 (see FIG. 9) with a lip 56 and a recess 58 between the side 45 and the bottom bowl flange 54. A hollow coupling, generally illustrated as 60, is provided with a threaded inside wall 62, a flange 64, and a plurality of fins 66 which circumscribe the outside surface of the hollow coupling 60. The hollow coupling 60, as indicated in FIG. 9, is slidably disposed within the bowl bottom 48 such that the flange 64 of the coupling 60 is releasably engaged by the lip 56 of the bottom bowl flange 54. Also provided is a hollow bushing, generally illustrated as 68, having threaded ends 70 and 72, a front bushing flange 74 with a flange recess 76, and a rear bushing flange 78 on threaded end 72 and spaced from the front bushing flange 74 to define a rear bushing recess 80 between the front bushing flange 74 and the rear bushing flange 78. The hollow bushing 68 also includes a bushing plate 82 positioned over the end of threaded end 70 and has a plurality of apertures 84 wherethrough air can pass. A bushing gasket 86 is disposed within the flange recess 76. As illustrated in FIG. 9, threaded end 70 of the hollow bushing 68 threadably engages the threaded inside wall 62 of the hollow coupling 60. A threaded lid, generally illustrated as 86, threadably engages the threaded end 72 of the hollow bushing 68. The lid 86 has a lug 88 and a washer 90 positioned against and on the inside of the lid 86 and against the periphery of the end of the threaded end 72 such that there is a tight seal therearound. A strap, generally illustrated as 92, is provided to include eyes 94, 96 and 98. As shown in FIG. 9, eye 94 lodges over and around lug 88. Similarly, eye 96 and eye 98 respectively lodge in and around recess 58 and rear bushing recess 80.

The pump means 42 additionally includes an elbow means, generally illustrated as 100, having a threaded end 102 engaged threadably to the threaded inside wall 62 of the hollow coupling 60 and end 104 that has (as indicated in FIGS. 19, 20, 21 and 22) a diaphragm 106 that opens when air is being taken in through the open threaded end 72 that is open after the lid 86 has been removed. A bellows member 108 is provided with an air intake aperture 110 wherethrough the end 104 of the elbow means 100 is slidably disposed (see FIG. 20), and an air exit aperture 112. When the bellows member 108 is pumped up and down (such as with a foot 112 in FIG. 23) when the lid 86 has been removed off of threaded end 72 of the hollow bushing, the expansion of the bellows member 108 causes diaphragm 106 to be moved in direction of the dotted line in FIG. 21 and air is drawn in through an open threaded end 72, through the aperture 84 of the plate member 82, through the elbow means 100 (by passing diaphragm 106) and into the bellows member 108. Diaphragm 106 releases the air compressor of the bellows member 108 to seal off the elbow means 100 while indrawn air within the bellows member 108 is passed through the air exit aperture 112 of the bellows member 108 and into the housing 36 of the air mattress 20.

Figure 13:
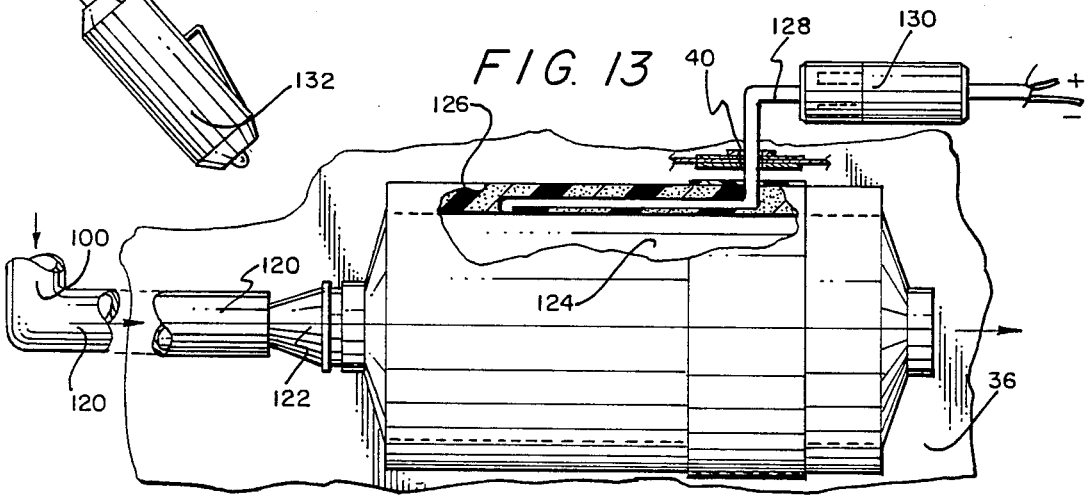
FIG. 13 is a partial side elevational view of the motor means used to inflate the air mattress.

In another preferred embodiment of the invention, the elbow means 100 has an elbow connector 120 (see FIG. 13) slidably engaged to the end thereof that is opposed to the threaded end 102. One end of an elbow male fitting 122 also slidably engages the elbow connector 120, and a motor means 124 engages slidably the other end of the elbow male fitting 122. A pad 126 preferably surrounds the motor means 124 and a power cord 128 engages the motor means 124. The power cord 128 includes a switch 130 and a plug 132 that may be conveniently inserted into a cigarette lighter of a car to supply power to the motor means 124. The power cord 128 passes through the coil inlet/outlet aperture 40. When the power cord 128 is in communication with a power source and switch 130 is switched on, motor means 124 sucks in air from the outside and into the inside of the housing 36 of the inflatable air mattress 20, assuming lid 86 has been removed off of the threaded end 72 of the hollow bushing 68. After the air mattress 20 has been inflated to a desired level (see FIGS. 15–18), the power source is interrupted to the motor means 124 by switching the switch 130 to off, and the lid 86 is threaded back on the threaded end 72 to contain the air within the inflated air mattress.

While the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope of the invention as set forth.

I claim:

1. An inflatable air mattress comprising a mattress structure defining a mattress air intake aperture; a pump means disposed in said air mattress for intaking air through said mattress air intake aperture, said pump means comprising a bowl member having a bowl side and an open bowl top with a top diameter and a bowl bottom having a bottom opening with a bottom diameter smaller than the top diameter, said open bowl top having a top bowl flange that secures around said mattress air intake aperture, said bowl bottom having a structure defining a bottom bowl flange with a bowl lip and a bowl recess between the bowl side and the bottom bowl flange; a hollow coupling having a threaded inside wall and a flange coupling and a plurality of fins circumscribing the outside surface thereof, said hollow coupling is slidably disposed within said bowl bottom with said flange coupling releasably engaged by said bowl lip of said bottom bowl flange; a hollow bushing having a first threaded end, a second threaded end, a front bushing flange with a front flange recess, a rear bushing flange spaced from said front bushing flange on said second threaded end to define a rear bushing recess between said front bushing flange and said rear bushing flange, and a bushing plate disposed over an end of the hollow bushing on the first threaded end side and having a structure defining a plurality of bushing apertures; a bushing gasket means disposed in said front flange recess, said first threaded end threadably engages the threaded inside wall of said hollow coupling; a lid means having a lid lug and threadably engaged to said second threaded end of said hollow bushing; a lid washer means positioned against an end of the hollow bushing on the second threaded end side and against the inside of said lid means; a strap means having a structure defining a first eye, a second eye, and a third eye, said first eye being lodged over said lid lug, said second eye is disposed around and within said rear bushing recess and said third eye is positioned around and within said bowl recess; an elbow conduit means having a first connector end threadably engaged to the threaded inside wall of said hollow coupling and a second connector end including a diaphragm means that opens when air is being taken in through said mattress air intake aperture; a bellows member having an air intake aperture wherethrough said second connector end of said elbow conduit means is slidably disposed and an air exit aperture wherethrough air is expelled into the inside of said air mattress.

2. The inflatable air mattress of claim 1 additionally comprising a sleeping bag means having a bottom layer; a first intermediate layer secured to said bottom layer such as to form a first closeable pocket, said air mattress is slidably disposed within said first pocket such as to be between said bottom layer and said first intermediate layer; a first cushioning and insulation means imposed on said first intermediate layer; a second intermediate layer secured to said first intermediate layer such as to encapsulate said first cushioning and insulation means therebetween; a third intermediate layer attached to said second intermediate layer to form a second closeable pocket wherebetween the user of the sleeping bag means rests; a second cushioning and insulation means imposed on said third intermediate layer; and a top layer bound to said third intermediate layer to encapsulate said second cushioning and insulation means therebetween.

3. The inflatable air mattress of claim 2 additionally comprising a first zipper means secured to said bottom layer and to said first intermediate layer for closing and opening said closeable pocket.

4. The inflatable air mattress of claim 3 additionally comprising a second zipper means secured to said second and third intermediate layer for closing and opening said second closeable pocket.

5. An inflatable air mattress comprising a mattress structure defining a mattress air intake aperture and a coil inlet aperture; a pump means disposed in said ar mattress for intaking air through said mattress air intake aperture, said pump means comprising a bowl member having a bowl side and an open bowl top with a top diameter and a bowl bottom having a bottom opening with a bottom diameter smaller than the top diameter, said open bowl top having a top bowl flange that secures around said mattress air intake aperture, said bowl bottom having a structure defining a bottom bowl flange with a bowl lip and a bowl recess between the bowl side and the bottom bowl flange; a hollow coupling having a threaded inside wall and a flange coupling and a plurality of fins circumscribing the outside surface thereof, said hollow coupling is slidably disposed within said bowl bottom with said flange coupling releasably engaged by said bowl lip of said bottom bowl flange; a hollow bushing having a first threaded end, a second threaded end, a front bushing flange with a front flange recess, a rear bushing flange spaced from said front bushing flange on said second threaded end to define a rear bushing recess between said front bushing flange and said rear bushing flange, and a bushing plate disposed over an end of the hollow bushing on the first threaded end side and having a structure defining a plurality of bushing apertures; a bushing gasket means disposed in said front flange recess, said first threaded end threadably engages the threaded inside wall of said hollow coupling; a lid means having a lid lug and threadably engaged to said second threaded end of said hollow bushing; a lid washer means positioned against an end of the hollow bushing on the second threaded end side and against the inside of said lid means; a strap means having a structure defining a first eye, a second eye, and a third eye, said first eye being lodged over said lid lug, said second eye is disposed around and within said rear bushing recess and said third eye is positioned around and within said bowl recess; an elbow conduit means having a first connector end threadably engaged to the threaded inside wall of said hollow coupling and a second connector end; an elbow conduit connector engaged to said second connector end; an elbow male fitting engaged to said elbow conduit connector; a motor means for sucking air into said air mattress, said motor means releasably engaging said elbow male fitting and includes a power cord secured thereto and passing through said coil inlet aperture to communicate with a power source.

6. The inflatable air mattress of claim 5 additionally comprising a sleeping bag means having a bottom layer; a first intermediate layer secured to said bottom layer such as to form a first closeable pocket, said air mattress is slidably disposed within said first pocket such as to be between said bottom layer and said first intermediate layer; a first cushioning and insulation means imposed on said first intermediate layer; a second intermediate layer secured to said first intermediate layer such as to encapsulate said first cushioning and insulation means therebetween; a third intermediate layer attached to said second intermediate layer to form a second closeable pocket wherebetween the user of the sleeping bag means rests; a second cushioning and insulation means imposed on said third intermediate layer; and a top layer bound to said third intermediate layer to encapsulate said second cushioning and insulation means therebetween.

7. The inflatable air mattress of claim 6 additionally comprising a first zipper means secured to said bottom layer and to said first intermediate layer for closing and opening said closeable pocket.

8. The inflatable air mattress of claim 7 additionally comprising a second zipper means secured to said second and third intermediate layer for closing and opening said second closeable pocket.

9. A combination of a sleeping bag and an air matress comprising a sleeping bag means having a bottom layer; a first intermediate layer secured to said bottom layer such as to form a first closeable pocket an air mattress slidably disposed within said first pocket such as to be between said bottom layer and said first intermediate layer; a first cushioning and insulation means imposed on said first intermediate layer; a second intermediate layer secured to said first intermediate layer such as to encapsulate said first cushioning and insulation means therebetween; a third intermediate layer attached to said second intermediate layer to form a second closeable pocket wherebetween the user of the sleeping bag means rests; a second cushioning and insulation means imposed on said third intermediate layer; and a top layer bound to said third intermediate layer to encapsulate said second cushioning and insulation means therebetween; a first zipper means secured to said bottom layer and to said first intermediate layer for closing and opening said closeable pocket; a second zipper means secured to said second and third intermediate layer for closing and opening said second closeable pocket; said air mattress comprising a mattress structure defining a mattress air intake aperture and a coil inlet aperture; a pump means disposed in said air mattress for intaking air through said mattress air intake aperture, said pump means comprising a bowl member having a bowl side and an open top with a top diameter and a bowl bottom having a bottom opening with a bottom diameter smaller than the top diameter, said open bowl top having a top bowl flange that secures around said mattress air intake aperture, said bowl bottom having a structure defining a bottom bowl flange with a bowl lip and a bowl recess between the bowl side and the bottom bowl flange said pump means further includes a motor means for sucking air into said air mattress, said motor means releasably connected to said bowl member and includes a power cord secured thereto and passing through said coil inlet aperture to communicate with a power source.

10. The combination of claim 9 additionally comprising a hollow coupling having a threaded inside wall and a flange coupling and a plurality of fins circumscribing the outside surface thereof, said hollow coupling is slidably disposed within said bowl bottom with said flange coupling releasably engaged by said bowl lip of said bottom bowl flange.

11. The combination of claim 10 additionally comprising a hollow bushing having a first threaded end, a second threaded end, a front bushing flange with a front flange recess, a rear bushing flange spaced from said front bushing flange on said second threaded end to define a rear bushing recess between said front bushing flange and said rear bushing flange, and a bushing plate disposed over an end of the hollow bushing on the first threaded end side and having a structure defining a plurality of bushing apertures.

12. The combination of claim 11 additionally comprising a bushing gasket means disposed in said front flange recess, said first threaded end threaded end threadably engages the threaded inside wall of said hollow coupling.

13. The combination of claim 12 additionally comprising a lid means having a lid lug and threadably engaged to said second threaded end of said hollow bushing; a lid washer means positioned against an end of the hollow bushing on the second threaded end side and against the inside of said lid means.

14. The combination of claim 13 additionally comprising a strap means having a structure defining a first eye, a second eye, and a third eye, said first eye being lodged over said lid lug, said second eye is disposed around and within said rear bushing recess, and said third eye is positioned around and within said bowl recess.

15. The combination of claim 14 additionally comprising an elbow conduit means having a first connector end threadably engaged to the threaded inside wall of said hollow coupling and a second collector end.

16. The combination of claim 15 additionally comprising an elbow conduit connector engaged to said second connector end; an elbow male fitting engaged to said elbow conduit connector.

* * * * *